United States Patent [19]

Krolak et al.

[11] 4,031,968

[45] June 28, 1977

[54] CUSHIONED PUSH DOZER DEVICE

[75] Inventors: Ronald L. Krolak, Morton; Duane L. Parker, Peoria, both of Ill.

[73] Assignee: Caterpillar Tractor Co., Peoria, Ill.

[22] Filed: Oct. 28, 1975

[21] Appl. No.: 626,421

[52] U.S. Cl. ..... 172/801; 172/267; 172/265

[51] Int. Cl.[2] ..... E02F 3/76

[58] Field of Search ..... 172/801, 803, 804, 802, 172/805, 806, 807, 809; 37/42 VL

[56] References Cited

UNITED STATES PATENTS

| | | | |
|---|---|---|---|
| 2,029,545 | 2/1936 | Ross | 172/801 X |
| 2,031,463 | 2/1936 | Choate et al. | 172/801 |
| 3,158,944 | 12/1964 | Rehberg et al. | 172/803 |
| 3,187,448 | 6/1965 | Kolinger | 172/803 |
| 3,226,858 | 1/1966 | Spannhake | 172/801 X |
| 3,265,380 | 8/1966 | Hall et al. | 172/801 X |
| 3,503,457 | 3/1970 | Smith et al. | 172/803 |
| 3,883,965 | 5/1975 | Poirier et al. | 172/801 X |

*Primary Examiner*—George J. Marlo
*Attorney, Agent, or Firm*—John W. Grant

[57] ABSTRACT

A resilient push dozer arrangement includes a push dozer transversely disposed at one end of a vehicle and a push arm rigidly secured to and extended from the dozer in juxtaposition to a longitudinally extending mounting frame of the vehicle. The distal end of the push arm is attached to the mounting frame through a device which permits limited longitudinal movement of the dozer relative to the mounting frame. An apparatus for cushioning the longitudinal movement of the push dozer toward the vehicle is provided so that the shock loads applied to the dozer are cushioned thereby and transmitted to the mounting frame at a point widely spaced from the attachment device.

7 Claims, 3 Drawing Figures

CUSHIONED PUSH DOZER DEVICE

BACKGROUND OF THE INVENTION

This invention relates to push dozers for tractors and more particularly to resiliently mounted push dozers for cushioning the impact loads applied against the dozer.

It is common practice to employ a tractor as a pusher for assisting in the loading of earthmoving scrapers. The bulldozer blades of such dozers are commonly provided with resilient cushioning devices behind the blade for protecting the vehicle components from the shock forces imposed on the tractor frame upon initial contact between the blade and the scraper push block. Cushioning the blade heretofore has been done by pivotally mounting either the top or bottom of the blade to the push arms and placing a resilient member or members behind the blade. However, with this type of blade mounting, the position of the blade in relation to the push block of the scraper is very critical. For example, with the bottom pivoted blade, if the blade is too low, it will run underneath the push block lifting the scraper off the ground and possibly damaging the scraper's tires. Conversely, should the blade be too high, the shock absorbing device becomes ineffective resulting in high shock loads to block vehicles. With the top pivoted blade, if the blade is too low relative to the push block, the shock absorbing devices become ineffective while if the blade is too high the front of the push tractor is lifted off the ground decreasing its pushing capability.

OBJECTS OF THE INVENTION

Accordingly, an object of this invention is to provide an improved resilient push dozer arrangement for attachment to a push vehicle for cushioning the shock forces upon initial contact of the dozer and the scraper push block.

Another object of this invention is to provide such an improved resilient push dozer arrangement which effectively cushions the impact between the dozer and the push block regardless of their respective vertical positions.

Another object of this invention is to provide an improved resilient push dozer arrangement of the character described which resiliently transmits the shock forces directly to the structurally strongest portion of the vehicle frame.

Other objects andd advantages of the present invention will become more readily apparent upon reference to the accompanying drawings and following description.

DESCRIPTION OF THE PREFERRED EMBODIMENT

Figure 1:
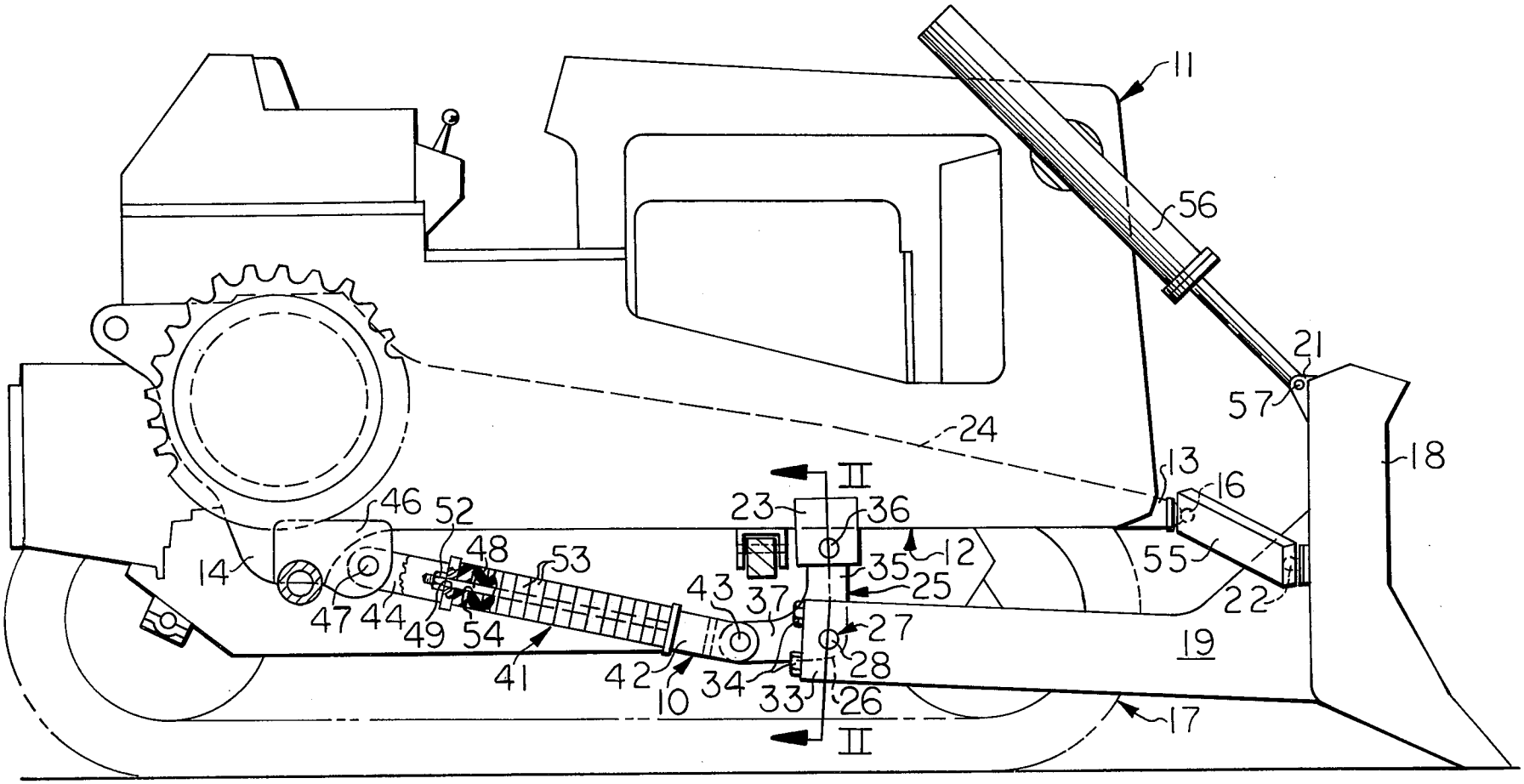
FIG. 1 is a sidde elevational view of a resilient push dozer arrangement embodying the principles of the present invention in association with a crawler tractor having one track assembly removed for illustrative convenience.

Referring now to the drawings, a resilient push dozer arrangement embodying the principles of the present invention is generally indicated by the reference numeral 10 in association with a crawler tractor 11. The crawler tractor includes a longitudinally extending mounting frame 12 having a forward end 13 and a rearward portion 14. A spherical ball 16 is mounted to the forward end of the mounting frame at one side thereof. A pair of track assemblies are disposed on opposite sides of the mounting frame and secured thereto in the usual manner.

Figure 3:
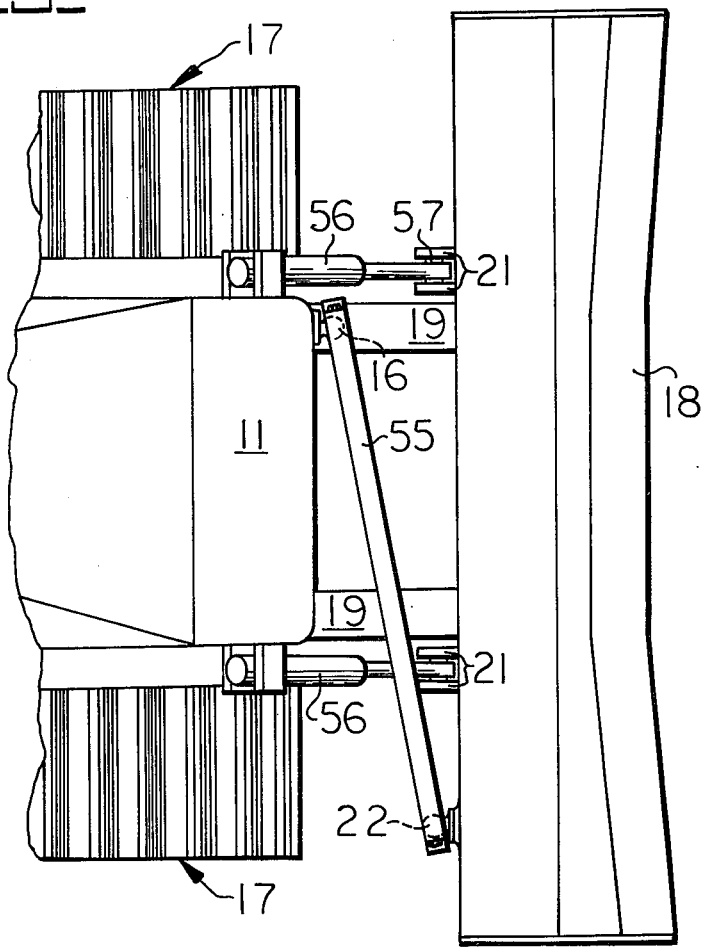
FIG. 3 is a top plan view of the push dozer and the forward end of the crawler tractor.

A push dozer 18 is transversely disposed at the forward end of the tractor and has a pair of laterally spaced rearwardly extending push arms 19 rigidly secured to the rear side thereof as more clearly shown in FIG. 3. The push arms extend beneath the mounting frame at opposite sides thereof and inboard of the track assemblies. Two pairs of transversely spaced brackets 21 are secured to the rear side of the dozer adjacent to its upper edge. A spherical ball 22 is secured to the rear side of the dozer blade adjacent to the end of the dozer disposed furthest away from the spherical ball 16.

Figure 2:
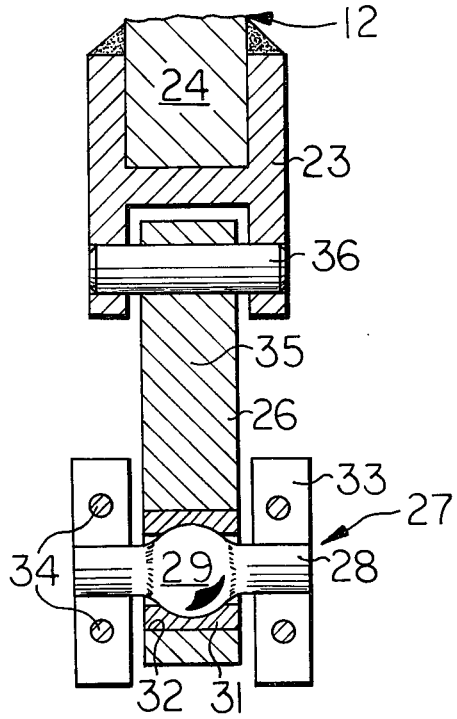
FIG. 2 is an enlarged sectional view taken along line II—II of FIG. 1.

As more clearly shown in FIG. 2, an H-shaped bracket 23 is secured to the mounting frame 12 vertically above the distal end of the respective push arm 19. The bracket straddles a main frame member 24 and is secured thereto as by welding or the like. A bell crank shaped connecting link or member 25 has its apex 26 pivotally connected to the distal end of the push arm by a ball and socket type connection 27. The ball and socket connection includes a pin 28 having a spherical mid portion 29 disposed within a matching spherical bearing 31 disposed in a bore 32 extending through the connecting member. The ends of the pin 28 are clamped to the end of the push arm by a pair of retainer blocks 33 secured thereto by a plurality of bolts 34. A vertically disposed arm 35 of the connecting member extends upwardly from the apex into the bracket and is pivotally or swingably connected thereto by a pivot pin 36 thereby suspending the distal end of the push arm beneath the mounting frame to permit limited longitudinal movement of the push arm and dozer. Another arm 37 of the connecting member extends horizontally rearwardly from the ball and socket connection.

An elongated resilient cushion link 41 has an end member 42 pivotally connected to the arm 37 of the connecting member 25 by a pin 43 and an opposite end member 44 pivotally connected to a bracket 46 by a pin 47. The bracket is rigidly secured to the main frame member 24 at the rearward portion 14 of the mounting frame. The resilient link includes an elongated rod 48 having an end fixedly secured to the end member 42 and its other member slidably extending through a bore 49 formed in the end member 44. A nut 52 is screw threaded onto the end of the rod extending through the member 44 and is adapted for abutment with the end member to establish a fixed maximum length of the link. The fixed length of the link operates to limit the forward longitudinal movement of the push arms 19 and push dozer 18 thereby establishing the forwardmost position of the push dozer. A plurality of resilient rubber discs 53 each have a central aperture 54 extending therethrough and are slidably disposed on the rod in a stacket side-by-side relation between the end members. Alternately, the rubber discs may be replaced by a coil compression spring.

Although not shown, the brackets 23 and 46, the connecting member 25 and the resilient link 41 are duplicated in a symmetrical mirror image fashion on the far side of the tractor.

An elongated tag link 55 has an end pivotally connected to the spherical ball 22 on the back side of the dozer and its other end pivotally connected to the ball 16 at the forward end of the mounting frame 12 to provide lateral stability of the dozer. A pair of hydraulic jacks 56 are pivotally secured to the mounting frame at opposite sides thereof. The rod of each hydraulic jack is pivotally connected by a pin 57 to the respective pair of brackets 21 secured to the rear side of the dozer.

OPERATION

While the operation of the present invention is believed clearly apparent from the foregoing description, further amplification will subsequently be made in the following brief summary of such operation. The vertical position of the push dozer 18 is controlled by the hydraulic jacks 56 with the push arms 19 pivoting about the ball and socket connections 27. The hydraulic jacks and the connecting members 25 are both swingable in a longitudinal direction about their respective pivots such that any longitudinally applied force against the push dozer is exerted against the resilient links 41 compressing the rubber discs. The resilient links in turn transmit the forces directly to the rearward portion of the main frame which rearward portion being the structurally strongest component of the tractor.

When the crawler tractor is being used as a pusher for pushloading earthmovving scrapers, the shock loads created when the push dozer 18 engages the push block of the scraper are transmitted through the push arms 19, the ball and socket connections 27, the arms 37 of the connecting members 25 and are cushioned or dampened by the rubber discs 53 of the resilient links 41. The dampened forces are ultimately transmitted by the resilient links to the rearward portion of the main frame. It is readily apparent from the drawings that raising of the push dozer will have only minimal effect on the vertical orientation of the push dozer. Any loads exerted transversely against the pusher dozer are transmitted directly to the forward end of the main frame through the tag link 55 and the spherical ball 16.

In view of the foregoing, it is readily apparent that the structure of the present invention provides an improved resilient push dozer arrangement for cushioning the shock loads upon initial contact of the dozer and the scraper push block. The push dozer is mounted such that the dozer along with the push arms moves horizontally rearwardly against the resiliency of the resilient links and thereby is effective for cushioning shock loads regardless of where the shock loads are applied to the dozer. By supporting the distal ends of the push arms with swinging links supported from the mounting frame and providing resilient links between the swinging link and the rearward portion of the main frame, the forces applied longitudinally to the dozer are transmitted directly to the strongest structural portion of the vehicle frame.

While the invention has been described and shown with particular reference to the preferred embodiment, it will be apparent that variations might be possible that would fall within the scope of the present invention, which is not intended to be limited except as defined in the following claims.

What is claimed is:

1. A resilient push dozer arrangement for a vehicle having a longitudinally extending mounting frame, comprising;

a push dozer transversely disposed at one end of the vehicle;

an elongated push arm rigidly secured to and extended from such dozer in juxaposition below said mounting frame of the vehicle;

means for swingably attaching the push arm to the mouting frame so that the push arm and hence the push dozer is movable in a rearward direction relative to the mounting frame when an impact load is applied in a rearward direction to the push dozer, said means including a rigid supporting link having an end pivotally attached to the mounting frame and pivotally connected to and swingably supporting the distal end of the push arm; and means for cushioning the rearward movement of the push dozer and push arm so that shock loads applied to the push dozer are cushioned and transmitted in a rearward direction to the mounting frame at a point relatively widely spaced from said attaching means by the cushioning means independent of the attaching means.

2. The resilient push dozer arrangement of claim 1 wherein the supporting link is a bell crank shaped member having an apex pivotally attached to the distal end of the push arm, a first arm extending substantially vertically upwardly and swingably connected to the mounting frame, and a second arm pivotally connected to the cushioning means.

3. The resilient push dozer arrangement of claim 2 wherein the mounting frame has a force absorbing end opposite to its end adjacent said push dozer, and said cushioning means includes a resilient link extending between and pivotally connected to the force absorbing end of the mounting frame and the second arm of the bell crank shaped member.

4. The resilient push dozer arrangement of claim 3 wherein the resilient link includes a first end member pivotally attached to the second arm, a second end member pivotally attached to the force absorbing end of the mounting frame, an elongated rod having one end secured to one of the end members and an opposite end slidably connected to the other end member, and resilient means disposed between the end members in circumscribing relation to the rod.

5. The resilient push dozer arrangement of claim 4 wherein said resilient means includes a plurality of rubber discs having a central aperture extending therethrough and disposed in stacked side-by-side relation between the end members.

6. The resilient push dozer arrangement of claim 5 including a transversely disposed elongated tag link having one end pivotally connected to the end of the mounting frame adjacent to said push dozer and its opposite end being pivotally connected to the push dozer.

7. The resilient push dozer arrangement of claim 1 including a hydraulic jack pivotally mounted on the mounting frame and having its rod pivotally attached to the push dozer for controlling the elevational position of the push dozer relative to the mounting frame.

* * * * *